US005255792A

United States Patent [19]

Harper et al.

[11] Patent Number: 5,255,792

[45] Date of Patent: Oct. 26, 1993

[54] METHOD AND APPARATUS FOR SORTING DISKS DEPENDING UPON THEIR THICKNESS

[75] Inventors: Bruce M. Harper, San Jose, Calif.; Shinji Takane, Kumagaya, Japan

[73] Assignee: HMT Technology Corporation, Fremont, Calif.

[21] Appl. No.: 990,537

[22] Filed: Dec. 10, 1992

Related U.S. Application Data

[63] Continuation of Ser. No. 605,113, Oct. 22, 1990, abandoned.

[51] Int. Cl.[5] ..... B07C 5/08

[52] U.S. Cl. ..... 209/605; 209/601; 209/653; 209/909; 414/417

[58] Field of Search ..... 209/601, 604, 605, 651, 209/653, 909, 933; 414/273, 331, 403, 404, 417

[56] References Cited

U.S. PATENT DOCUMENTS 4,826,019 5/1989 Kondo et al. ..... 209/933 X
4,998,987 3/1991 Jacobs ..... 209/604 X

FOREIGN PATENT DOCUMENTS 0182846 10/1983 Japan ..... 414/417
1366349 1/1988 U.S.S.R. ..... 414/417

*Primary Examiner*—Andres Kashnikow
*Assistant Examiner*—Joseph A. Kaufman
*Attorney, Agent, or Firm*—Peter J. Dehlinger

[57] ABSTRACT

The method and apparatus of this invention are to sort disks into predetermined ranks depending on their thickness. The disks are conveyed stepwise in each supply cassette at equal intervals, and partly pushed to measure their thickness. They are transferred from the supply cassette to a receiving cassette of the corresponding thickness rank.

4 Claims, 7 Drawing Sheets

METHOD AND APPARATUS FOR SORTING DISKS DEPENDING UPON THEIR THICKNESS

This application is a continuation of application Ser. No. 07/605,113, filed Oct. 22, 1990, now abandoned.

FIELD OF THE INVENTION

The present invention relates to a method and an apparatus for sorting disks depending on their thickness in the process of producing them.

BACKGROUND OF THE INVENTION

Magnetic disks are produced through various steps, including working, sorting, conveying, etc. For instance, in the case of magnetic disks made of aluminum, round plates (disks) of aluminum are plated and then polished.

However, since disks may differ in substrate thickness and plating thickness, finished disks do not necessarily have the same thickness.

On the other hand, the polishing of disks can be effectively conducted when they have the same thickness. For this purpose, it is important that plated disks (semi-finished disks) are sorted depending on their thickness.

For sorting semi-finished disks, various methods and apparatuses are already reported.

For instance, Japanese Patent Laid-Open No. 62-225283 discloses a disk-sorting apparatus comprising (a) a supply means for supplying plural types of disks having different diameters and thickness to predetermined positions in plural numbers per each type; (b) a support means for supporting one of plural types of disk-holding members in an upright manner, the disk-holding members being positioned corresponding to plural types of the disks; (c) a supply manipulator disposed between the supply means and the support means for conveying one disk from the supply means to the support means in an upright manner; (d) a means for measuring a thickness of each disk conveyed to the support means; (e) a means for receiving each disk, which is sorted into a predetermined rank depending upon measurement results, from the support means in an upright manner; and (f) a sorting manipulator disposed between the support means and the receiving means for transferring a measured disk from the support means to one portion of the receiving means in an upright manner.

Japanese Patent Publication No. 63-56831 discloses a sorter comprising trays for containing parts, a transfer means for taking out each part from each tray by holding it by a chuck and transferring it to a supply means intermittently, a conveying means for conveying each part to a means provided with two pairs of fingers for regulating a position of each part, a measurement means for measuring a size of each part, and ranked empty trays for receiving measured trays depending upon their measurement results. The sorting of each part into each ranked tray is carried out by a robot having X-, Y- and Z-axis arms.

In the sorting process in which disks are measured with respect to thickness and sorted depending upon their thickness, the damaging and deformation of disks should be prevented while keeping high measurement and sorting speeds. Further, from the aspect of operability, it is desirable that thickness ranges in which disks are ranked and the number of ranks can be easily changed.

In the disk-sorting apparatus of Japanese Patent Laid-Open No. 62-225283, since each disk is gripped, it is likely to be damaged. Also, since each means such as a measurement means and a sorting manipulator moves, high-speed measurement and sorting cannot be achieved.

In the sorter of Japanese Patent Publication No. 63-56831, since a part is taken out from the tray by a chuck and conveyed intermittently without any cover, it is likely to be damaged, and it takes much time to adjust the position of a part. Namely, this sorter is not satisfactory with respect to damage prevention and operation speed.

OBJECT AND SUMMARY OF THE INVENTION

An object of the present invention is to provide a method of sorting disks depending on their thickness at high measurement and sorting speed, while preventing them from being damaged and deformed.

Another object of the present invention is to provide an apparatus for conducting such a sorting method.

The apparatus of sorting disks into predetermined thickness ranks comprising (a) at least one supply cassette for containing a plurality of disks at equal intervals; (b) a stepping means for conveying said disks contained in said supply cassette stepwise in a direction perpendicular to said disks; (c) a first pushing means for pushing a periphery of each disk so that a part of said disk is exposed from said supply cassette; (d) a sensor means for measuring said exposed part of said disk; (e) a plurality of disk-receiving means for receiving each disk of the corresponding rank; and (f) at least one second pushing means disposed opposite to each of said disk-receiving means for pushing each disk of the corresponding rank into the corresponding disk-receiving cassette.

The method of sorting disks into predetermined thickness ranks according to the present invention comprises the steps of (a) moving said disks contained in a supply cassette stepwise according to intervals of said disks arranged in said supply cassette, by a stepping means; (b) pushing each disk in the supply cassette by a first pushing means so that a part of said disk is exposed from the supply cassette; (c) measuring a thickness of an exposed portion of said disk to generate thickness data which are then supplied to a control means; (d) ranking each of said disks depending upon its thickness data; (e) conveying each of said disks to a sorting position where a second pushing means and a disk-receiving means are disposed opposite to each other via said stepping means; and (f) when each ranked disk is positioned opposite to a disk-receiving cassette of the corresponding rank in said disk-receiving means, actuating said second pushing means to push each ranked disk into the corresponding receiving cassette.

DETAILED DESCRIPTION OF THE PREFERRED EMBODIMENTS

The present invention will now be described in greater detail with reference to the accompanying drawings.

Figure 1:
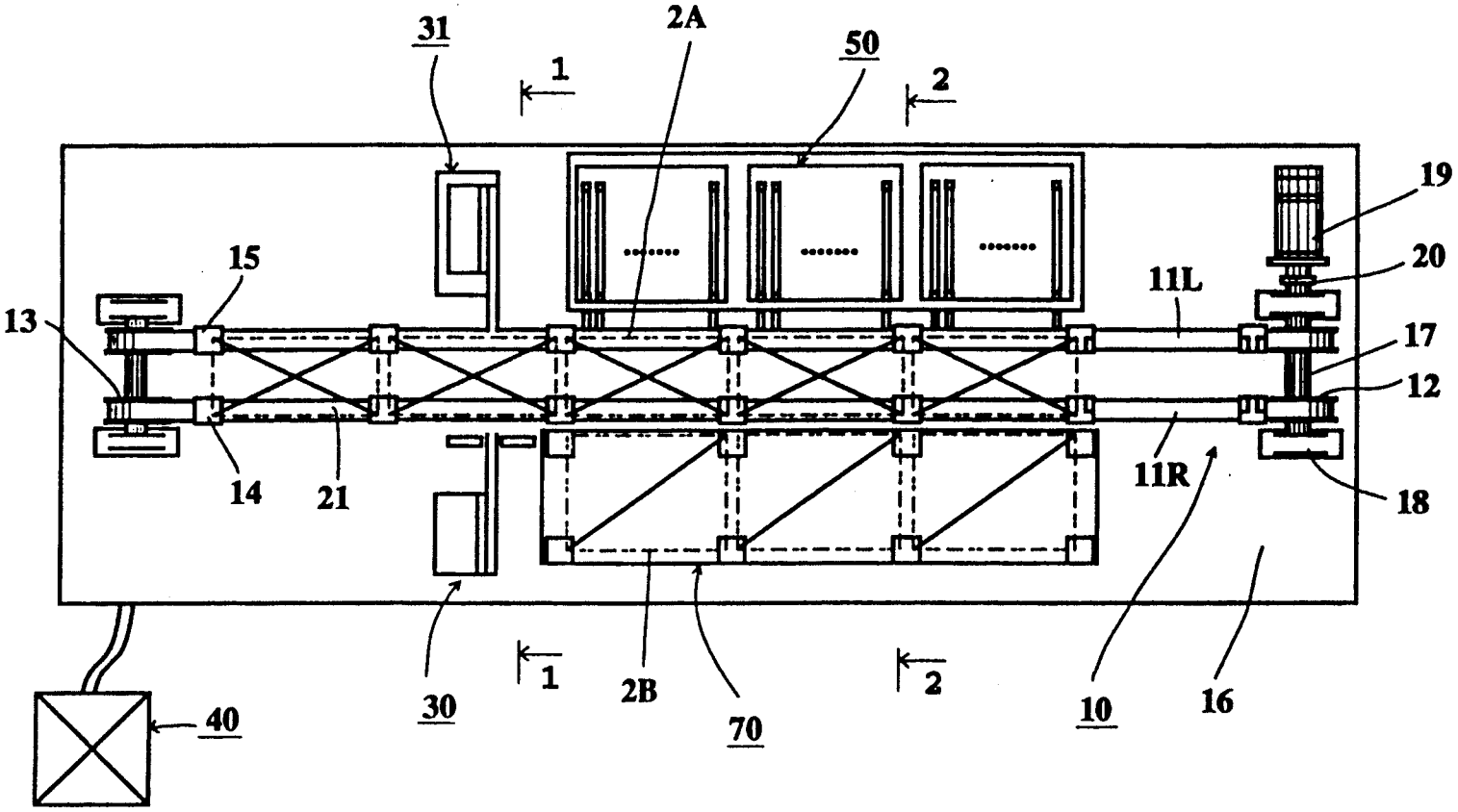
FIG. 1 is a schematic view showing the overall structure of the apparatus according to one embodiment of the present invention.

Referring to FIG. 1, the apparatus of the present invention comprises a base 16, a conveyor 10 functioning as a stepping means, a pusher 31 (first pushing means) disposed along the conveyor 10, and a measurement means 30 disposed opposite to the pusher 31 via the conveyor 10.

A second pushing means 50 is disposed in alignment with the first pushing means 31 along the conveyor 10 and a disk-receiving means 70 are disposed opposite to the second pushing means 50 via the conveyor 10.

The stepping means may be in any type, including a belt-type, a chain-type, a rack-type, a cylinder-type, etc., as long as it can move stepwise linearly like the conveyor 10. For instance, in the case of the conveyor 10, a driving shaft 17 having a driving pulley 12 is mounted to the base 16 via bearings 18, and a driven pulley 13 is also supported by the base 16 via bearings. The conveyor 10 is comprised of endless belts 11L, 11R extending around the driving pulley 12 and the driven pulley 13. The endless belt 11L is provided with a plurality of pieces 15 and the endless belt 11R is provided with a plurality of pieces 14 for carrying supply cassettes 2A. The pieces 14, 15 are mounted to the endless belts 11L, 11R, with an interval corresponding to the interval of grooves 3 of each supply cassette 2A in FIG. 2 multiplied by an integer. The belts 11L, 11R are easily moved stepwise when they are timing belts. The driving shaft 17 for the conveyor 10 is connected to a pulse motor 20 via a coupling 19, and the pulse motor 20 is electrically connected to a control means 40.

2A represents a supply cassette, and a plurality of supply cassettes are supported by the pieces 14 and 15 of the conveyor 10, such that each supply cassette is inclined by about 5 degrees upward with respect to its side and horizontal line, so that an opening IN of each supply cassette is directed slightly upward. The position of the supply cassette 2A is determined by the pieces 14, 15 having different heights.

A receiving means 70 is constituted by a plurality of receiving cassettes 2B having substantially the same shape as that of the supply cassette 2A, and the receiving means 70 are provided opposing to the second pushing means 50.

Figure 2:
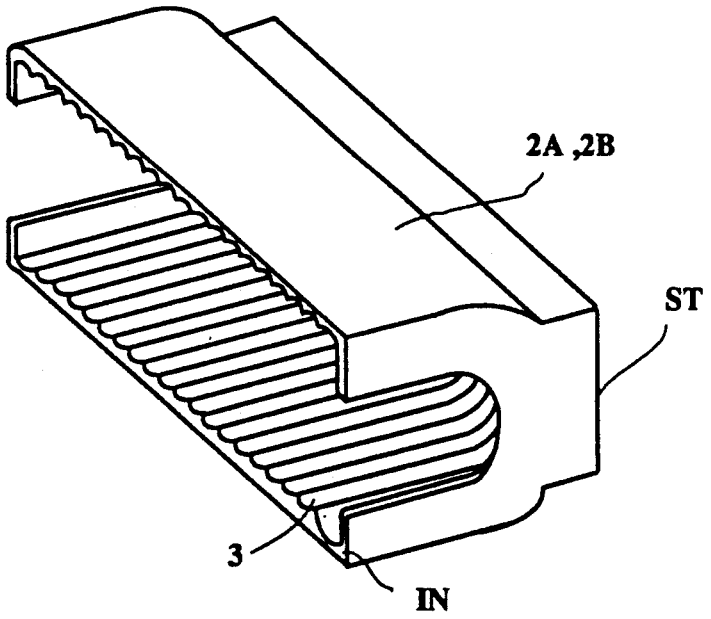
FIG. 2 is a perspective view showing a supply cassette.

As shown in FIG. 2, the supply cassette 2A is provided with 25 grooves 3 extending in perpendicular to the opening IN in an inner surface of the supply cassette at an equal interval. The supply cassette 2A is also provided with a bottom opening ST.

Disks 1 are contained in the supply cassette 2A arranged regularly with an equal interval by these grooves 3.

Figure 3:
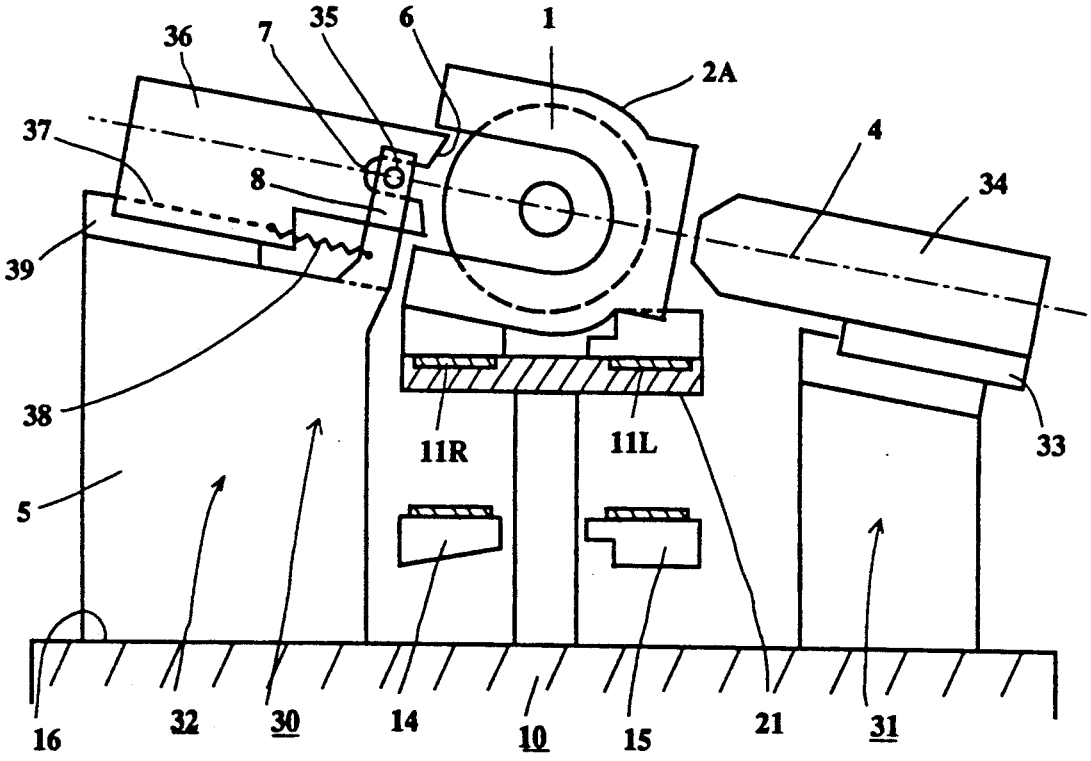
FIG. 3 is a cross-sectional view taken along the line 1—1 in FIG. 1.

FIG. 3 is a cross-sectional view taken along the line 1—1 of FIG. 1 for showing a pusher 31 as a first pushing means and a measurement means 30. In this Figure, the pusher 31 is positioned on the right side of the conveyor 10, and the measurement means 30 is positioned on the left side.

A supply cassette 2A is disposed on the conveyor 10, such that its opening IN is inclined slightly upward, and by a stepping action of the belts 11L, 11R along the guide 21, the supply cassette 2A also moves stepwise while its position is controlled by the pieces 14, 15.

The pusher 31 is constituted by a bar 34 having a V-shaped groove at a tip end thereof, which is fixed to a linear movement unit 33 constituted by a cylinder or a link.

The bar 34, the supply cassette 2A, the disk 1 and a sensor 35 are aligned along an axis 4 which is inclined about 5 degrees with respect to a horizon.

The measurement means 30 is constituted by a pair of sensors 35 which may be of an electrostatic capacitance-type, and a means 32 for positioning the disks 1.

The positioning means 32 is constituted by a guide 39 fixed to a top surface of a support 5 projecting from a base 16 and a blade 36 having a groove 37 into which the guide 39 is slidably fitted, and a spring 38 for connecting an end of the blade 36 to the support 5, whereby the blade 36 can move back and forth along the guide 39. The blade 36 is provided at its end surface with a pushing surface 6 engageable with the periphery of the disk 1, and the pushing surface 6 is provided with a U-shaped notch 7. The support 5 is provided with a pair of extensions 8 to which a pair of sensors 35 are mounted, such that their detection sides are opposing to each other. The disk 1 is movable in a gap between a pair of sensors 35.

Figure 4:
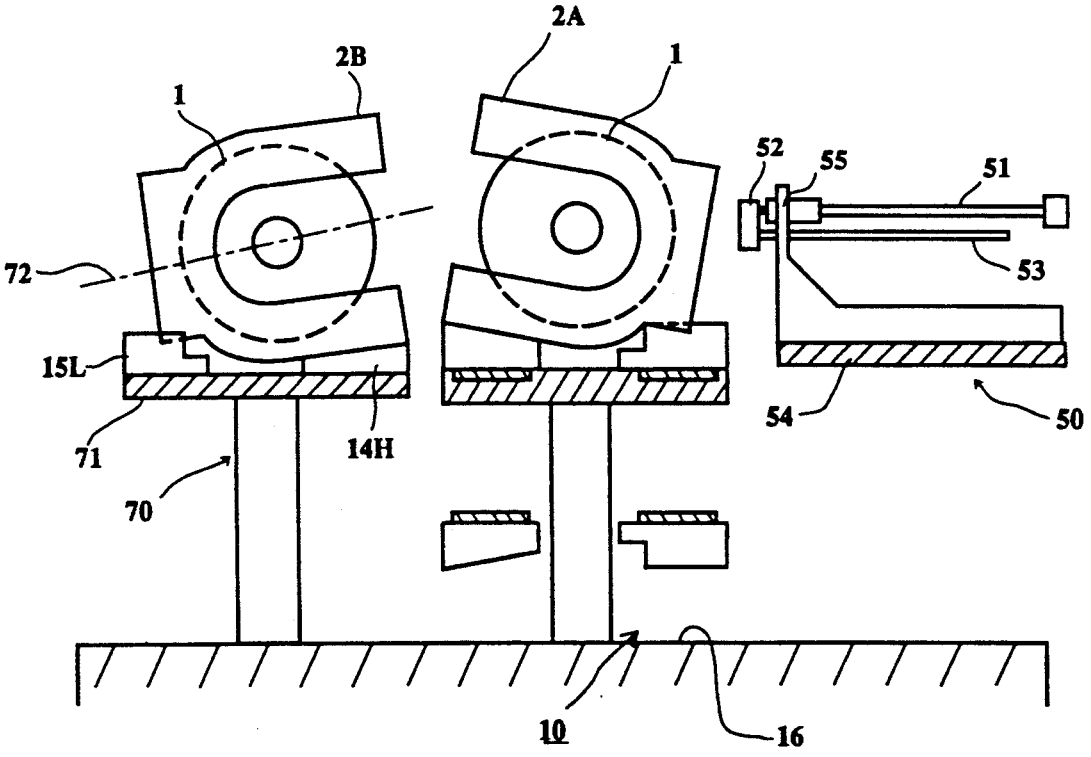
FIG. 4 is a cross-sectional view taken along the line 2—2 in FIG. 1.

FIG. 4 is a cross-sectional view taken along the line 2—2 of FIG. 1, showing the positional relation between the second pushing means 50 and the disk-receiving means 70 with respect to the conveyor 10.

The second pushing means 50 comprises a bracket 55 fixed to the base 16 via a frame 54, and a cylinder 51 fixed to the bracket 55 and having a movable rod provided with a pushing member 52 at its operating end. The guide rod 53 is fixed to the pushing member 52 and slidable along an aperture of the bracket 55. The cylinder 51 may be a compressed air-type, a hydraulic-type, a mechanical-type, etc., as long as it can push the disk 1 leftward in the Figure.

The same number of the cylinders 51 as that of the grooves 3 of each supply cassette 2A are contained in one block, and a plurality of blocks are arranged. An interval between the cylinders 51 is the same as that between the grooves 3 of the supply cassette 2A.

The disk-receiving means 70 comprises pieces 14H and 15L having different heights each fixed to the base 16 via a frame 71, and the position of the receiving cassette 2B is regulated by this disk-receiving means 70.

The height of the pieces 14H, 15L is adjusted such that an opening IN of the receiving cassette 2B is directed to the conveyor 10, and that an axis 72 of the receiving cassette 2B is inclined about 5 degrees from the horizon. The number of the receiving cassette 2B is determined depending on the number of thickness ranks of the disks 1 to be sorted.

Figure 5:
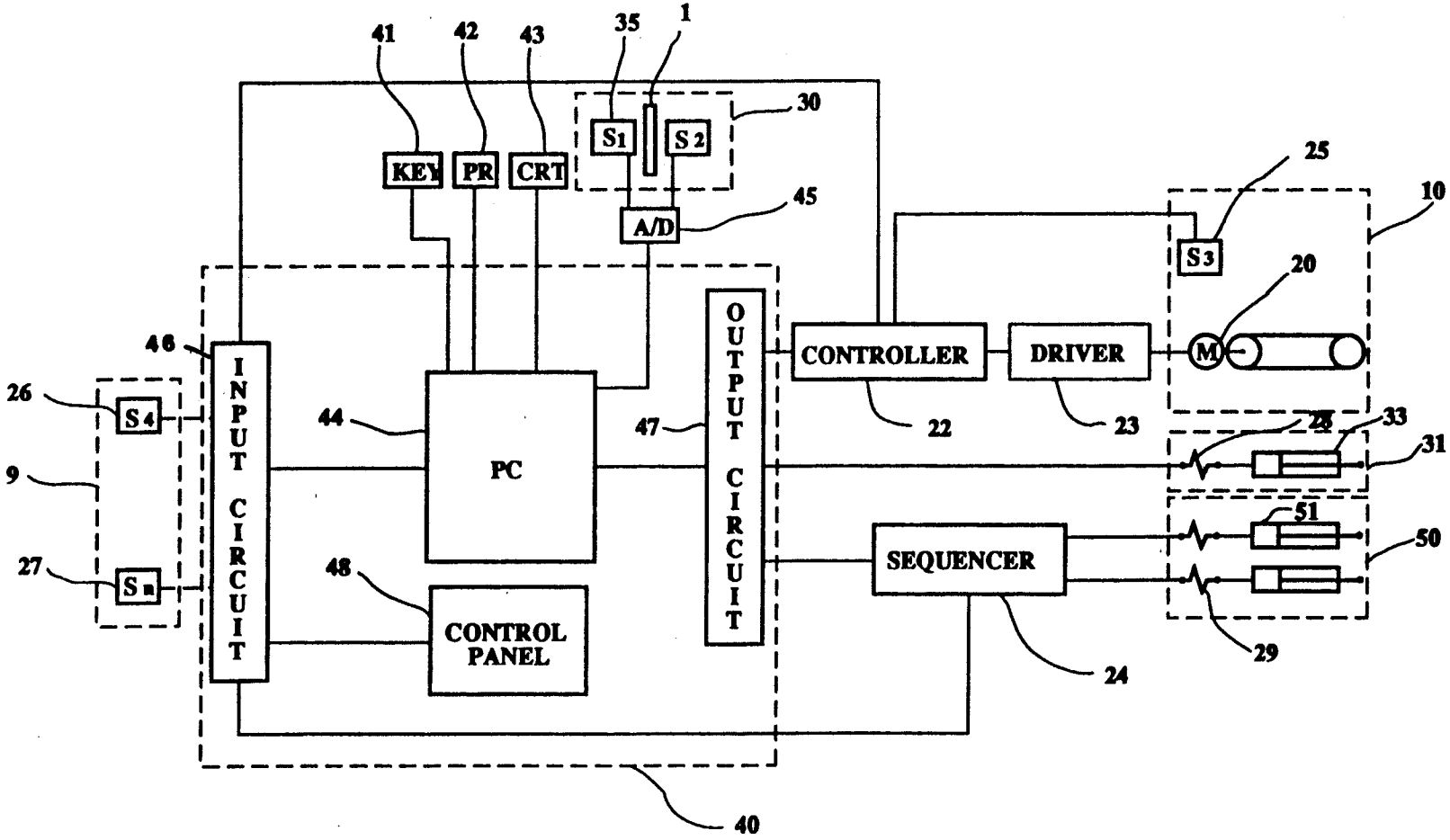
FIG. 5 is a view showing a control circuit according to one embodiment of the present invention.

A control means 40 will be explained referring to FIG. 5.

A measurement means 30 has a pair of sensors 35 connected to a computer 44 via an A/D converter 45. The computer 44 has a keyboard 41, a printer 42 and a CRT 43 each connected to the computer 44.

The computer 44 is also connected to an input circuit 46 and an output circuit 47, and a control panel 48 is connected to the computer 44 via the input circuit 46.

The output circuit 47 is connected to a driver 23 via a controller 22, and the driver 23 is connected to a pulse motor 20 for moving the conveyor 10. An origin sensor 25 adjacent to the pulse motor 20 is connected to the controller 22, which is in turn connected to the input circuit 46.

The output circuit 47 is further connected to a solenoid valve 28 communicating with the linear-movement unit 33 of the pusher 31, and a sequencer 24 connected to solenoid valves 29 communicating with the cylinders 51 of the second pushing means 50. The sequencer 24 is further connected to the input circuit 46.

A sensor 9 for confirming safety is disposed adjacent to the cylinders 51, the supply cassettes 2A and the disks 1, and it is constituted by a plurality of sensors 26, 27. Each sensor 26, 27 is electrically connected to the input circuit 46.

Figure 6:
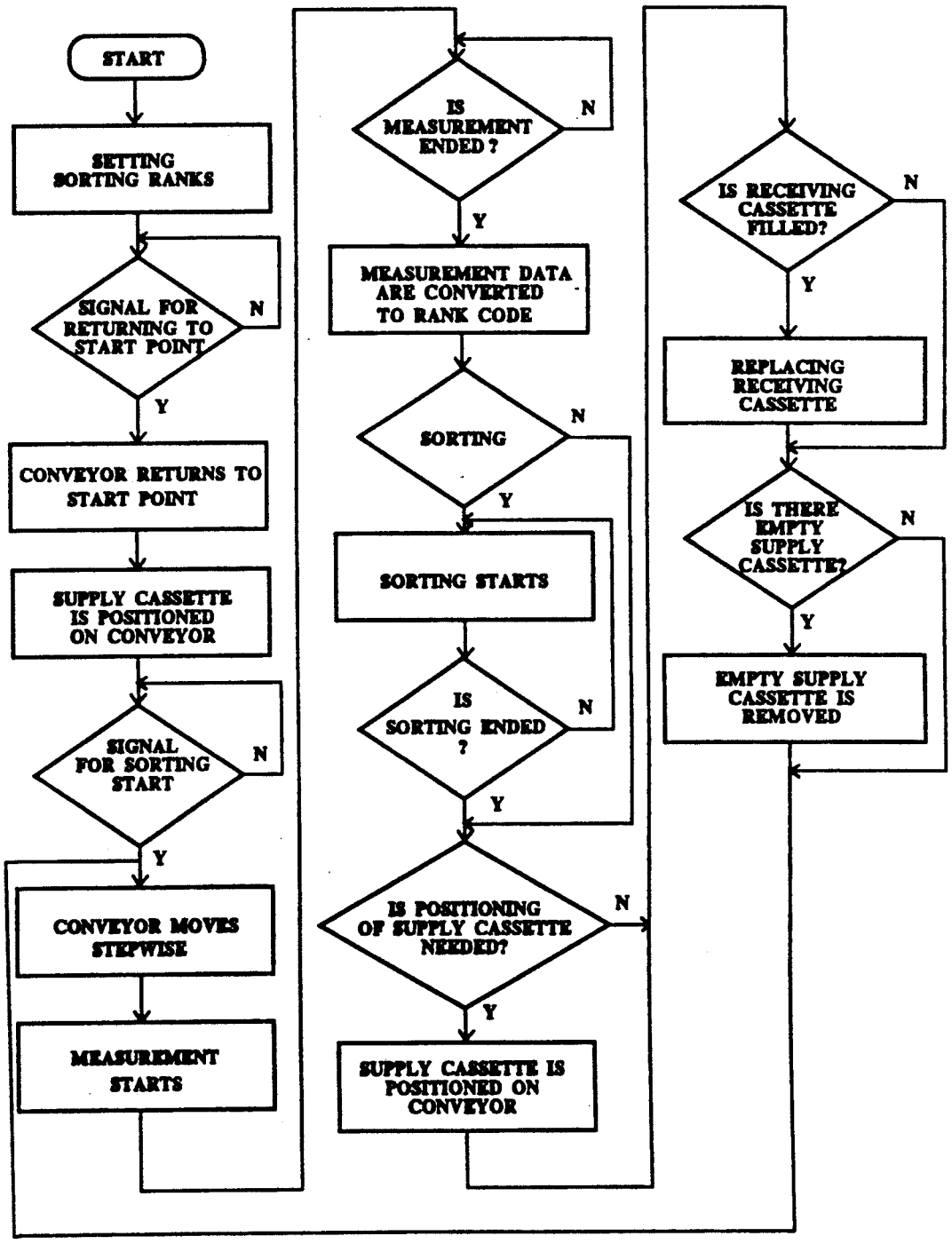
FIG. 6 is a flow chart according to the present invention.

Next, the operation of the circuit according to the present invention will be explained referring to FIG. 6.

At the start of the operation, sorting rank data are supplied to the computer 44 by the keyboard 41, and stored in a memory of the computer 44. After reading the sorting rank data, a reset button of the control panel 48 is pressed to provide a signal for returning the conveyor 10 to a starting point thereof. After that, each supply cassette 2A containing disks 1 with equal intervals is disposed at a predetermined position on the conveyor 10. Next, a sorting start button of the control panel 48 is pushed to provide a signal for permitting the conveyor 10 to move stepwise.

When a first disk 1 in the supply cassette 2A reaches a position opposing to the measurement means 30 by stepping movement, the measurement is initiated. A periphery of the disk 1 is pushed by the bar 34 of the pusher 31, so that it enters into a gap between a pair of sensors 35 of the measurement means 30 to conduct measurement.

The measurement data are supplied to an A/D converter 45, and converted to rank codes by the computer 44 and stored. In the computer 44, sorting operating is conducted based on the sorting rank data, rank codes and the signal from the input circuit 46.

In each stepping movement of the conveyor 10, the computer 44 decides which cylinder 51 should be operated, and generates a signal for actuating such cylinder 51.

Upon receiving the disk sorting signals, the disks 1 are successively sorted.

When all of the disks 1 in one supply cassette 2A are measured, a new supply cassette 2A is conveyed to a predetermined position on the conveyor 10. Thereafter, the measurement and sorting are repeated continuously until the receiving cassette 2B is filled with the disks. When the receiving cassette 2B is filled, it is replaced by a new empty receiving cassette 2B. When the disks 1 are transferred from the supply cassette 2A to the receiving cassette 2B by the cylinder 51, the supply cassette 2A becomes empty. When all of the supply cassette 2A on the conveyor 10 become empty, they are replaced.

When the receiving cassette 2B is filled, or when the empty supply cassette 2A reaches to the end of the conveyor 10, stepping movement is stopped, and it is displayed on the control panel 48 and CRT 43.

Figure 7:
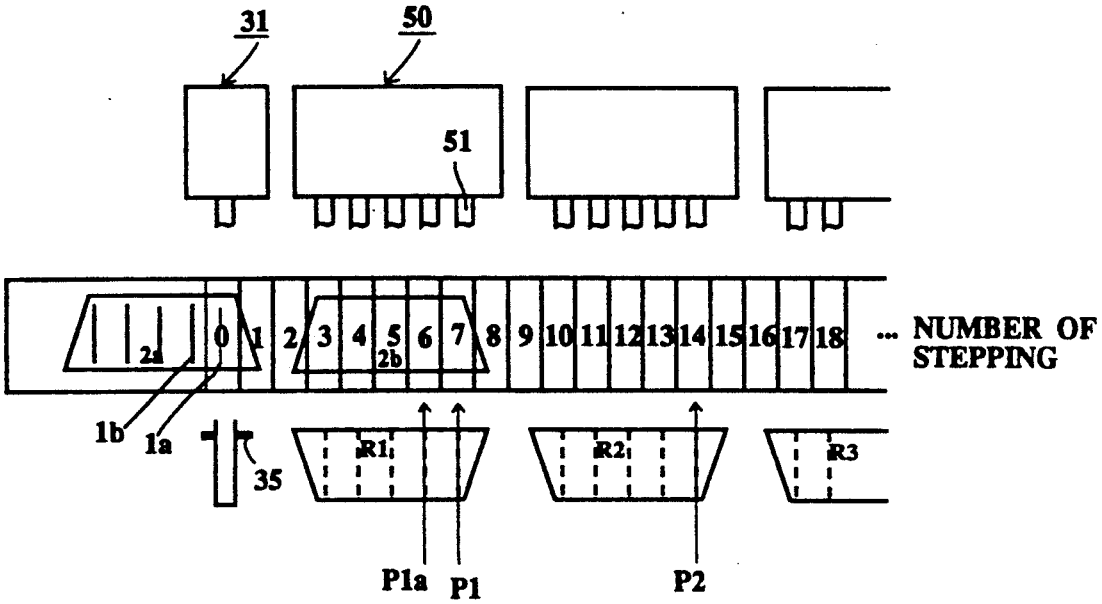
FIG. 7 schematically shows algorithm according to the present invention.

The sorting control algorithm will be explained referring to FIGS. 7 and 8.

The supply cassettes 2A are represented by **2*a*, 2*b*, 2*c*, . . . in the order of disposition on the conveyor 10, and disks 1A are represented by 1*a*, 1*b*, 1*c*, . . . in the order of stepping, and the receiving cassettes 2B are represented by R1, R2, R3**, . . . by their ranks. The number of counting upon stopping the stepping is defined as a stepping number P.

When a disk **1*a* in the first supply cassette 2*a* is measured by the sensor 35**, the number of stepping P is defined as "0."

If the measurement data corresponds to rank R1, the address A is memorized as "0," and the rank code R is memorized as "1." Next, the conveyor 10 is moved stepwise, and the next disk **1*b* is measured with respect to its thickness. If the measurement data corresponds to rank R5**, the address A is memorized as "1," and the rank code R is memorized as "5."

After completion of the measurement of first supply cassette 2A by repeating the above procedure, and before the next supply cassette 2B reaches the sensor 35, the rank code R is memorized as "0."

When the measured disk **1*a* reaches a first receiving position P1 of the rank R1, it is judged whether or not the memorized rank code of the disk 1*a*** is equal to the rank code "1."

Figure 8:
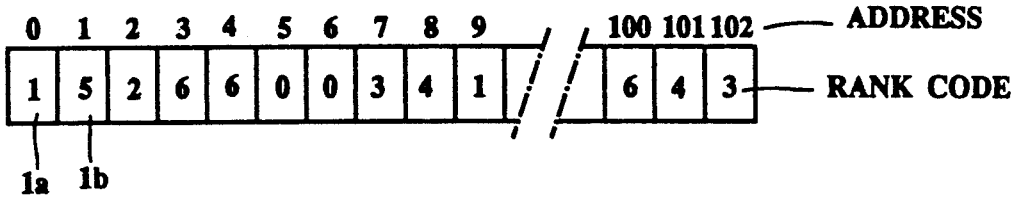
FIG. 8 is a schematic view showing an address A and rank code R corresponding to disks 1*a*, 1*b* to achieve the algorithm shown in FIG. 7.

The address A of the rank code of the disk **1*a* is a value obtained by subtracting the first receiving point P1=7 of the rank R1 from the present number of stepping P=7, namely "0."Here, since the rank code of the address A=0 is "1," equal to rank code "1" of the rank R1 as shown in FIG. 8, a computer 44 generates an actuating signal of the signal 51**.

Next, in a state without stepping, it is judged whether or not the disk **1*a* should be received at a receiving position P1a in rank R1. At this time, the address A in which the rank code of the disk 1*b* is stored is a value obtained by subtracting the receiving point P1a**=6 from the present number of stepping P=7, namely "1."

Since the rank code at the address A=1 is "5" as shown in FIG. 8, the rank code "1" of rank R1 is not identical thereto, whereby the judgment of whether or not the disk is received by rank R1 is completed.

Then, based on the address data produced by the computer 44, the cylinder 51 is actuated.

After completion of the operation of the cylinder 51, the conveyor 10 again moves stepwise to repeat the same judgment and processing as mentioned above.

With respect to other ranks R2, R3, . . . , the same judgment and sorting are carried out as in rank R1.

The method and apparatus according to the present invention have the following advantages:

(1) Since measurement, conveying, sorting, and positioning are conducted by the stepping operation of disks, the disks are sorted into proper thickness ranks by a simple system.

(2) Since the disks are conveyed in each supply cassette, they are not damaged during operation.

(3) Since the disks are transferred by pushing their peripherals, the disk surfaces are not damaged.

(4) Since the disks are always conveyed while being kept vertical, it is less likely that floating dusts are attached to the disk surfaces.

(5) Since the disks are transferred from the supply cassette to the receiving cassette by rolling action therebetween, they are easily and quickly transferred. A cycle time in each transfer of a disk from the supply cassette to the receiving cassette is 2 seconds or less.

Having thus described the preferred embodiments of the present invention, it should be understood that numerous structural modifications and adaptations may be resorted without departing from the spirit of the present invention.

What is claimed is:

1. An apparatus for sorting discs into predetermined thickness ranks comprising:

(a) a supply cassette for containing a plurality of disks at spaced intervals, said supply cassette being supported at an upwardly inclined position at which disks carried in the cassette will return to a seated position in the cassette, when the disks are moved to a position which is partially out of the cassette;

(b) stepping means for conveying said supply cassette to position each of the disks contained in the supply disc at a sensor position;

(c) a first pusher means for pushing the periphery of each disk which is at said sensor position in a direction in the plane of the disc to move the disc partially out of the cassette so that a part of the disk is exposed from said supply cassette;

(d) a sensor for measuring the thickness of said exposed part of said disk;

(e) a receiving cassette which provides a plurality of disk-receiving means for receiving each disc of the corresponding rank, said receiving cassette being positioned with respect to the supply cassette such that disks in the supply cassette, when pushed fully out of the supply cassette in a direction in the plane of the disc, will fall into a seated position in a selected disk-receiving means in said receiving cassette; and (f) at least one second pushing means disposed opposite to each of said disk-receiving means for pushing each disc of the corresponding rank fully out of the supply cassette, whereby the pushed disc falls into a seated position in the corresponding disc-receiving means in the disk-receiving cassette.

2. The apparatus of sorting disks according to claim 1, wherein said stepping means is a conveyor.

3. The apparatus of sorting disks according to claim 1, wherein said second pushing means is a cylinder.

4. The apparatus of sorting disks according to claim 1, wherein said sensor for measuring a disk thickness is an electrostatic capacitance sensor.

* * * * *